United States Patent [19]

Grather et al.

[11] 4,181,112

[45] Jan. 1, 1980

[54] HIGH-VOLTAGE IGNITION SYSTEM TO GENERATE A SPARK FOR AN INTERNAL COMBUSTION ENGINE, AND METHOD TO GENERATE THE SPARK ENERGY

[75] Inventors: Günter Gräther, Pinache; Josef Wahl, Stuttgart; Friedrich Rabus, Schwieberdingen; Bert Wurst, Möglingen; Karl-Heinz Adler, Leonberg, all of Fed. Rep. of Germany

[73] Assignee: Robert Bosch GmbH, Stuttgart, Fed. Rep. of Germany

[21] Appl. No.: 776,735

[22] Filed: Mar. 11, 1977

[30] Foreign Application Priority Data

Mar. 19, 1976 [DE] Fed. Rep. of Germany ..... 2611596

[51] Int. Cl.[2] ..... F02P 3/04

[52] U.S. Cl. ..... 123/148 E; 123/148 DC

[58] Field of Search ..... 123/148 DC, 148 CA, 123/148 CB, 148 CC, 148 E; 315/209 CD, 208, 232

[56] References Cited

U.S. PATENT DOCUMENTS

| | | | |
|---|---|---|---|
| 2,977,506 | 3/1961 | Short et al. | 123/148 CB |
| 3,329,867 | 7/1967 | Stearns | 315/209 CD |
| 3,581,726 | 6/1971 | Plume, Jr. | 123/148 E |
| 3,788,983 | 1/1974 | Anderson | 123/148 E |
| 3,889,651 | 6/1975 | Hudson | 123/148 E |
| 4,048,543 | 9/1977 | Owen et al. | 315/208 |

FOREIGN PATENT DOCUMENTS

| | | | |
|---|---|---|---|
| 2547397 | 5/1977 | Fed. Rep. of Germany | 123/148 E |

*Primary Examiner*—Charles J. Myhre
*Assistant Examiner*—P. S. Lall
*Attorney, Agent, or Firm*—Frishauf, Holtz, Goodman & Woodward

[57] ABSTRACT

Sequentially generated charge pulses are applied to the spark gap through a diode which prevents back-flow of energy applied to the spark gap, the capacity of the ignition cable, or a capacitor, and of the spark gap causing a build-up of charge accumulation as a result of the sequentially applied charges, until the gap breaks down; the breakdown voltage, therefore, will be determined by the conditions of the gap. The pulses are generated at a pulse repetition rate which is high with respect to the rate of generation of spark impulses through a circuit in which the respective capacities and winding ratios and inductances of the ignition coil and the cabling are controlled so that the pauses between sequentially generated spark pulses and the timing of the spark pulses can be matched to the system parameters.

22 Claims, 8 Drawing Figures

HIGH-VOLTAGE IGNITION SYSTEM TO GENERATE A SPARK FOR AN INTERNAL COMBUSTION ENGINE, AND METHOD TO GENERATE THE SPARK ENERGY

CROSS REFERENCE TO RELATED APPLICATIONS

U.S. Ser. No. 776,739, filed Mar. 11, 1977, now U.S. Pat. No. 4,114,585; RABUS et al;

U.S. Ser. No. 776,740, filed Mar. 11, 1977, now U.S. Pat. No. 4,112,890;

U.S. Ser. No. 776,738, filed Mar. 11, 1977; RABUS et al;

U.S. Ser. No. 776,734, filed Mar. 11, 1977; DECKER et al.; all assigned to the assignee of the present invention.

The present invention relates to a high-voltage ignition system, particularly to provide ignition energy for an internal combustion engine, and to a method to provide this high-voltage energy to the spark gap of a spark plug; and especially to a system in which a controlled switch is located in the primary circuit of an ignition coil, the secondary being connected to the spark gap of a spark plug through a uni-directional current-carrying device, such as a diode.

Ignition systems in which primary current through an ignition coil is interrupted are known; to improve ignition, it has also been proposed to generate more than one ignition impulse for each ignition event. Such an arrangement is usually suitable for complete, or essentially complete, combustion of a combustible fuel-air mixture in an internal combustion engine. If, however, an extremely high voltage pulse becomes necessary, for example due to poor maintenance of the spark plug, unfavorable combustion conditions, or the like, ignition may not effectively and continuously be provided in proper manner, so that ignition failure or misfires result. Increasing the ignition current through the ignition coil to obtain higher ignition voltages may, under some circumstances, be expensive and, additionally, lead to increased wear and deterioration of the spark plugs and associated equipment, such as switching elements, cables, connectors, and the like.

It is an object of the present invention to improve the ignition in internal combustion engines in which a multiplicity of ignition signals are provided for each ignition event and to generate high ignition voltages ensuring reliable firing of fuel-air mixtures within the cylinders of an internal combustion engine, preferably by multiple sparks. Additionally, the system should be capable of handling suddenly arising increased voltage requirements to effect breakdown of the spark, for example due to unfavorable operating conditions, deposits on the spark plugs and the like, by reliably insuring that ignition will occur.

SUBJECT MATTER OF THE PRESENT INVENTION

Briefly, an electronic control switch is repetitively operated for each ignition event by multiple sequentially occurring ignition signals. An electronic system so adjusts the length of the signals and the gaps between signals that a charge accumulation will occur at the spark gap of the spark plug until breakdown occurs. A high-voltage diode is connected in series with the ignition coil and the spark gap to prevent bleed-off, or back-flow of accumulated charge at the spark gap.

The invention additionally contemplates the steps of sequentially applying a charge to the spark gap and preventing back-flow of energy away from the spark gap to build up a charge accumulation as a result of the sequentially applied charges across the spark gap until a breakdown of the spark gap occurs. The voltage at breakdown may vary, in dependence on then existing operating conditions. Under ordinary circumstances, multiple breakdowns can be obtained for a single ignition event under design breakdown voltage conditions; under unfavorable operating conditions, however, a higher voltage will occur at the spark gap, yet still providing for breakdown and generation of at least one spark to ensure ignition.

The ignition coil which forms part of the ignition system can be constructed in various ways, and matched to the components of the ignition system, specifically to the capacities occurring therein. In accordance with a feature of the invention, the ignition coil is constructed to have parameters permitting its operation as a current voltage flow transformer. The pulse periods of the multiple ignition pulses, during any ignition event, are so arranged that the electronic switch is closed for a period of time corresponding to the pulse period, which is approximately that time which is needed to reach maximum voltage at the spark gap. The pauses, or time gaps between the pulses, during which the switch is opened, correspond in essence to the period of time which is necessary for the oscillatory swing-back of the circuit until the voltage at the capacity of the winding of the secondary of the ignition coil has dropped to a minimum from a maximum.

The ignition coil can also be operated as a blocking element or as a blocking inductance; in accordance with another embodiment of the invention, the length of the pulses during any ignition event falls within the linear range of the rise in current at the primary of the ignition coil; the pauses between the signals during any ignition event correspond essentially to the period of time which is necessary to reach maximum voltage at the spark gap.

The controlled switch preferably is a transistor; the transistor can be protected against overload, heating, or otherwise difficult operating conditions, in accordance with a feature of the invention, by sequential charge accumulation, or sequential charging, in steps, by current pulse trains in which the current pulses occur in groups or bundles. The signal lengths of the multiple ignition signals, during which the electronic switch is closed, will occur within the linear range of the current rise of the primary of the ignition coil; the signal gaps between the multiple ignition signals, during any ignition event, and when the switch is open, will be small in relation to the signal lengths. This improves efficiency of operation.

In accordance with a feature of the invention, the system includes a signal generator which has a signal generation repetition rate which is high with respect to the duration of a spark impulse during any ignition event. The signal generator is connected to control opening and closing of the switch. The signal generator has a fixed relationship of signal or pulse length to signal or pulse gap. The ignition events, themselves, are triggered by a control system, preferably including an electronic control element which is triggered by the crankshaft of the engine.

In accordance with a further feature of the invention, the ignition coil may be constructed as a current-voltage transformer element in combination with an electronic control system which includes a differentiator coupled to the ignition coil and a polarity recognition circuit, likewise coupled to the ignition coil, which is connected over a logical connecting network with the control input of the controlled switch.

The charge accumulation at the spark gap permits ignition voltages of various levels. The ignition coil thus can be constructed to have a relatively low transforming ratio. This results in a high re-charge current, at low primary current, and a low inner resistance. Operation can be obtained with extremely high spark repetition frequency although the transforming ratio of the ignition or spark coil is low. The spark repetition frequency can be increased if there is an additional air gap. The system can be so designed that the voltage during the first control pulse is just sufficient to effect ignition. Upon ignition failure, however, ignition will occur at the next pulse. Upon continued failure, ignition will occur at subsequently occurring pulses. The sequential charging, in steps, results in stepped increase in the ignition voltage. The stepped charging by means of current pulse trains or current pulse bundles results in low current flow through the electronic switch. This protects the electronic switch which usually is a transistor and, additionally, results in high efficiency of operation.

Drawings: illustrating an example:

Figure 1:
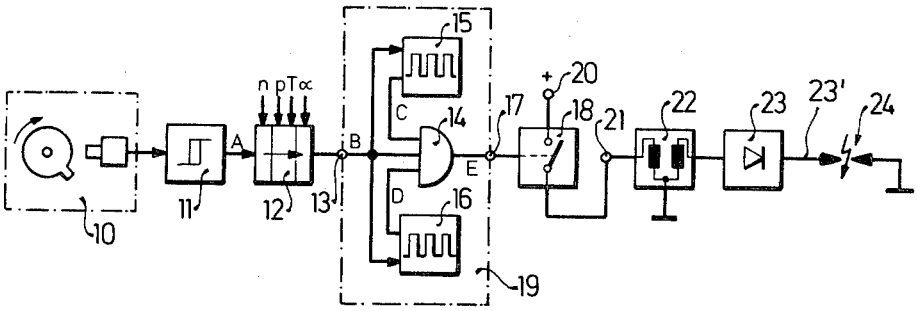
FIG. 1 shows a schematic block diagram of a system in accordance with the invention.

The crankshaft of an internal combustion engine, typically an automotive-type gasoline internal combustion engine, is coupled to a transducer 10 (FIG. 1) providing an output pulse whenever the crankshaft has reached a predetermined angular position with respect to the upper dead center (UDC) position of a piston thereof. The output from transducer 10 is coupled to a wave-shaping circuit 11, typically a Schmitt trigger. The transducer 10 may be of any suitable type, for example an inductive transducer, a cam-operated breaker switch, or the like. The output of wave-shaping stage 11 is connected to a circuit 12 providing for adjustment of the timing of the pulse with respect to the angular position of the crankshaft in accordance with operating parameters of the engine, such as engine speed (n), induction-type pressure or, rather, vacuum (p), engine or other temperature conditions (T) and deflection angle ($\alpha$) of the throttle of the engine. Other operating, ambient or operation parameters of the engine may also be introduced into stage 12. Stage 12, as such, is known and need not be described in detail. The output of stage 12, available at terminal 13, is connected to one input of an AND-gate 14. Two frequency generators 15, 16 are likewise connected to terminal 13 and have their outputs, respectively, connected to further inputs of AND-gate 14. The terminals to the frequency generators 15, 16 from terminal 13 are start terminals or gate terminals of the frequency generators so that output signals from the frequency generators 15, 16 are applied to AND-gate 14 only when terminal 13 has a signal appear thereat. The output of AND-gate 14 is formed by a terminal 17 which is connected to the control input of an electrical switch 18, preferably a transistor. The AND-gate 14 and the two frequency generators 15, 16 form an electronic control system 19 to control the interrupter switch 18. Power is supplied from a source of voltage connected to terminal 20, for example the battery of the vehicle. The main path of the switch 18, typically the emitter-collector path of a transistor, is connected to a further terminal 21 which is connected through the primary of an ignition coil 22 to ground or chassis forming the negative terminal of the source of supply 20. The secondary of the ignition coil 22 is connected through a high-voltage diode 23 with the spark gap, in case of an internal combustion engine, typically the spark plug of one of the cylinders. The second electrode of the spark gap is connected to ground or chassis. Both windings of the coil 22 are likewise connected to ground or chassis. A distributor can be interposed between diode 23 and the spark gap 24, or between the coil 22 and diode 23. Ignition cable 23' connects diode 23 to spark plug 24.

Figure 2:
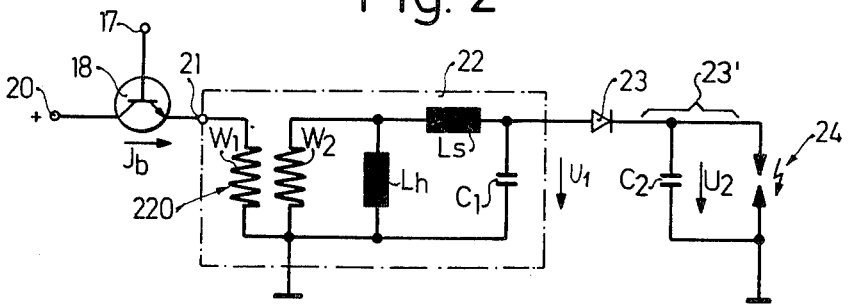
FIG. 2 is a detailed diagram of a portion of the system of FIG. 1 or FIG. 7.

FIG. 2 is the equivalent circuit diagram of a portion of FIG. 1, illustrating, specifically, the circuit components between terminals 17 and the spark gap 24. The reference numerals of FIG. 2 are identical to those of FIG. 1.

The spark gap 24 has, in parallel thereto, the capacity of the ignition cable 23'. This capacity is shown as an equivalent capacitor C2. The ignition coil 22, and particularly its secondary, is shown in detailed equivalent circuit. The turns ratio of the secondary W2 with respect to the primary W1 is represented by an ideal transformer 220. The main inductance Lh is shown in parallel to the secondary. The leakage or stray inductance Ls is shown connected in series with the output of the secondary winding W2 and the output of the coil 22. The winding capacity is shown as equivalent capacitor C1. The resistances of the windings have been neglected in this diagram since they are not material to an understanding of the operation of the present invention.

Figure 3:
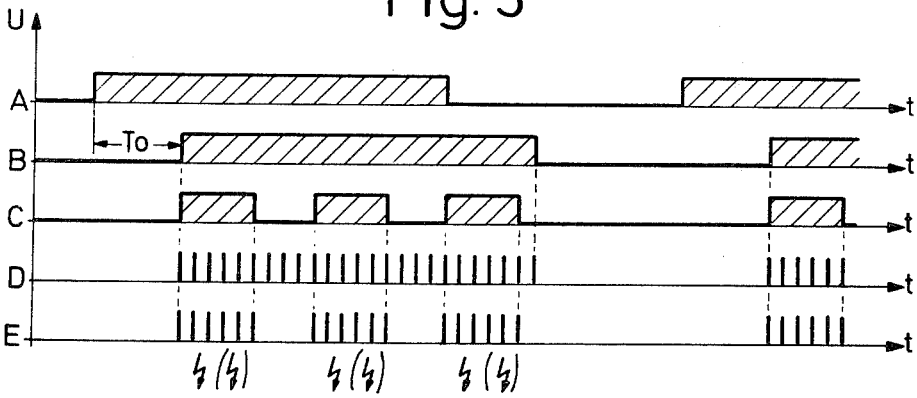
FIG. 3 is a timing diagram showing pulses, and used in connection with explanation of the operation of the system.

Operation, with reference to FIGS. 2 and 3: A signal from transducer 10 is shaped in stage 11 to provide a square wave pulse shown in graph A of FIG. 3; letters corresponding to the graphs of FIG. 3 have been added to FIG. 1 to show where the respective signals occur. The ignition timing stage 12 shifts the signal of graph A by a time To, to appear as the signal B, shown in FIG. 3 in graph B at terminal 13. The first frequency generator 15 provides a sequence of pulses shown in graph C of FIG. 3. The second frequency generator 16 provides a sequence of signals shown in graph D. As can be seen, the repetition rate of the signals D is substantially higher than that of the signals of graph A. The output of the AND-gate 14, appearing at terminal 17, then will have a signal as shown in graph E if, simultaneously, the signal of graphs B, C and D are applied thereto. Sequential signals E, applied through switch 18 to coil 22 and through diode 23 to the spark gap 24, result in a charge accumulation across the spark gap 24. This charge accumulation will continue until the spark gap breaks down and discharge of the spark gap occurs, and then starts again. During a sequence of pulses of graphs E, one or more ignition sparks can be generated depending on the requirements of the ignition voltage, that is, how many charges must be accumulated. Ignition is indicated by the ignition arrows beneath graph E of FIG. 3.

The frequency of the pulse sequence D is constant and substantially higher than the frequency of the transducer 10, that is, of the signal of graph A. The frequency of frequency generator 15 is intermediate that of the transducer 10 and of frequency generator 16. Varying the frequency and signal duration of signals of frequency generator C can be used to set the number of ignition sparks for any ignition event.

Charge accumulation, in accordance with a feature of the invention, is obtained by so adjusting the signals of graph E and graph D, respectively, which control the opening and closing of the switch 18, to have a predetermined signal length and signal pause and thereby effect build-up of charge accumulation, in the light of the electrical parameters of the system.

Figure 4:
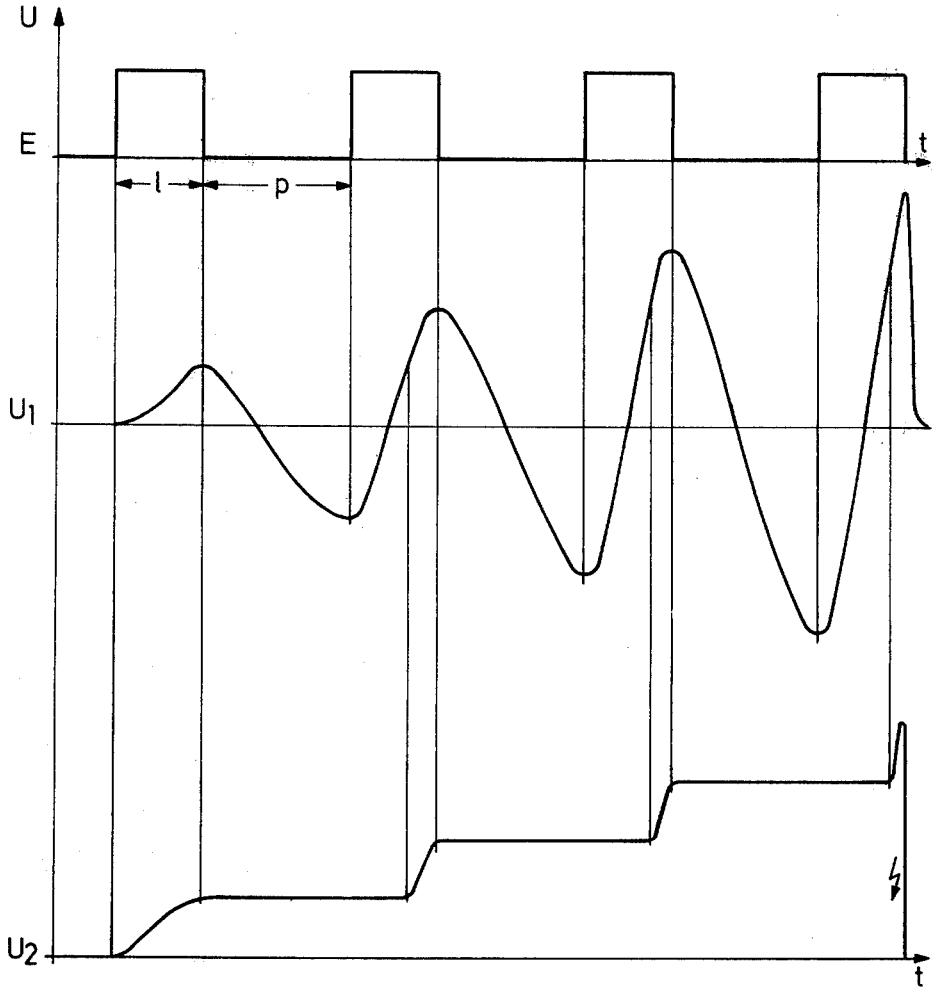
FIG. 4 is a voltage diagram illustrating one form of operation of the system of FIG. 2.

Referring now to FIG. 4, which illustrates voltage diagrams when using an ignition coil 22 constructed as a low current high voltage transformer. Such a coil will have a high winding ratio, that is, will have a large number of windings W2 with respect to the number of turns of winding W1. This results in a high main inductance Lh, and one in which the main inductance Lh is large in relation to the leakage inductance Ls. Voltage U1 at the secondary winding of the ignition coil 22 rises during any signal as illustrated in graph E (FIG. 3), causing a rise in voltage U2 at the spark gap 24 (see FIG. 4). The signal length 1 is so adjusted that the end of the signal will occur when the voltage U2 approximately has reached its maximum, that is, when the capacities represented by the capacitors C1, C2 have been charged through the leakage inductance Ls. The time of a signal E can thus be calculated, approximately, by equation (1) of the table of equations forming part of this specification.

The interrupter switch 18 is opened during the subsequent signal pause. The charge of the capacity C1 will thus oscillate back to the main inductance Lh. The duration of the signal pause p thus must be so determined that a new signal will start when the voltage U1 has, approximately, reached its minimum. The timing of the signal pause p thus can be determined, approximately, by equation (2).

The equivalent capacity C2 of the ignition cable 23' cannot discharge during the signal pause due to the blocked high-voltage diode 23. Voltage U2 thus remains essentially constant. The next subsequent signal illustrated at graph E in FIG. 3 thus causes a rise in the voltage U1 until, again, a maximum or approximately a maximum has been reached. Due to the resonance effect of this oscillation, the maximum will be higher than the maximum of the preceding wave of the oscillation. When the voltage exceeds the level of the voltage at which U2 previously had been held, then voltage U2 will rise, parallel to voltage U1, until, at the next gap between pulses, a level will be established as previously described. This accumulation of charge, or accumulation of voltage, at the spark gap 24 continues until the voltage U2 reaches a value which causes breakdown of the spark gap, that is, which is sufficient to cause firing of the spark plug. The cycle will then repeat if signals E are still present.

Figure 5:
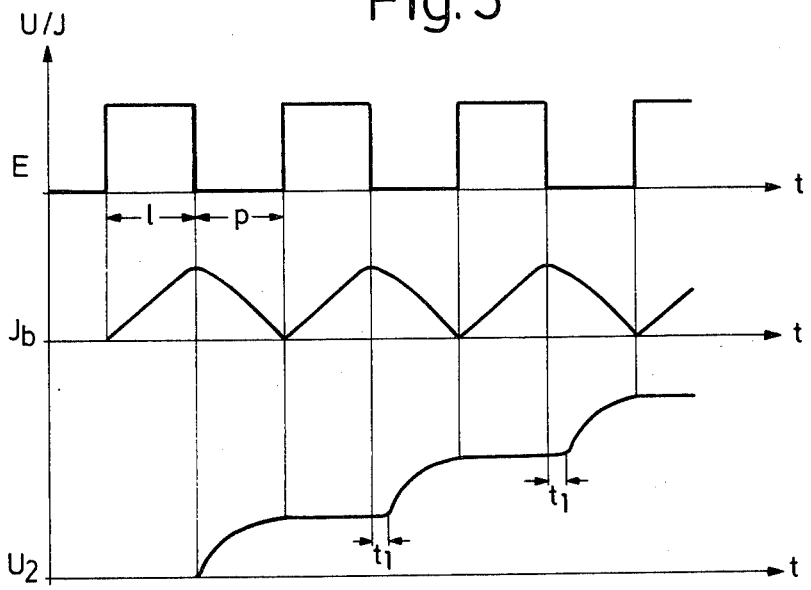
FIG. 5 is a voltage diagram illustrating another form of operation of the system of FIG. 2, in which the system has different parameters than those resulting in the operation in accordance with FIG. 4.

The system can operate differently as well, with different system parameters; as illustrated in FIG. 5, the ignition coil 22 can also operate as a blocking element, or blocking inductance. To effect blocking, the main inductance Lh must have a relatively low value to store magnetic energy and the leakage or stray inductance Ls should be as small as possible so that the transistors will not be excessively loaded by peaks arising during turn-off of the current through the coil.

The winding ratio W2 to W1 for a coil operating under those conditions should be small and is limited by the breakdown voltage of transistor 18, operating as the electrical interrupter switch. The relationship of windings is determined by equation (3) wherein Ut is the maximum permissible transistor voltage, and Ub is the supply voltage.

When the coil operates as a blocking transducer, the current Ib through coil 22 rises during signal E. This current rise, initially, is linear. The duration of the signal 1 is preferably limited so that the current rise of the current Ib remains in the linear range. During the subsequent gap in pulses for the duration p, the presence of the capacity in the circuit will cause an oscillation and transfer of charge from the main inductance Lh (FIG. 2) to the two capacities C1, C2. Current Ib drops, and the voltages at the capacities rise, particularly the voltage U2 at the capacity C2, which is the voltage across the spark gap 24 and the voltage of interest for purposes of the present invention. The rise in voltage is delayed by a time t1 due to the presence of the capacity C1. To obtain maximum voltage accumulation, the signal pause or gap p must be so timed or adjusted that a new signal E (FIG. 3) begins when the current Ib is approximately again at zero level, that is, when the voltage U2 has reached its maximum. The time of the signal gap can, essentially, be determined by the relationship of equation (4).

The high-voltage diode 23 holds the voltage U2 during the subsequent signal E during which current Ib (FIG. 5) again rises. At the next signal gap p, current Ib drops and voltage is again accumulated, causing a rise in voltage U2. The voltage accumulation of the voltage U2 increases until the necessary ignition voltage across the spark gap 24 has been reached and the spark breaks down which, in effect, for an internal combustion engine means that the spark plug has fired.

Figure 6:
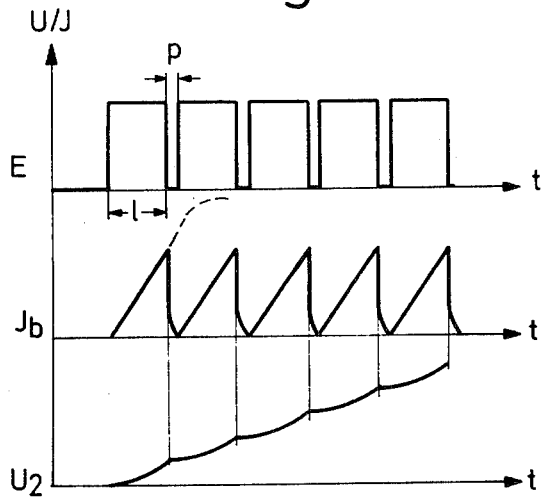
FIG. 6 is a current-voltage diagram illustrating operation with bundles of pulses or with rapidly recurring pulses of a pulse train.

Coil 22, operating as a current/voltage transformer as explained in connection with FIG. 4, can also be used to effect stepped charge accumulation by groups of current pulses, or by current pulse trains, or bundles of current pulses. The signals E are slightly changed from the illustration of FIG. 5; referring to FIG. 6, the charge accumulation of voltage U2 is obtained by short, rapidly recurring current pulses Ib through the switching path of the interrupter switch 18, and thus to the primary winding of ignition coil 22. The length l of a signal E (FIG. 6) is so adjusted that the current rise Ib remains in the linear range. During the rise in current, voltage U2 across the spark gap 24 also rises. The gap p between pulses is set to be very short so that the switch 18 opens only for a short period of time. Current Ib immediately drops to zero but immediately again starts to rise due to the next recurring signal E. Upon subsequent current rise, voltage U2 likewise rises again. The voltage U2 is held at its previous level by the high-voltage diode 23. Charge accumulation, that is, accumulation of the voltage U2, requires more charging steps when following this sequence in order to obtain sufficient ignition voltage; the pulse repetition rate of the pulses E can be selected to be higher, however. This arrangement has the advantage that the switch 18 is better protected since a comparatively smaller current flows through its switching path and the transistor usually operates in saturation. The efficiency of operation of the switch is also improved.

Figure 7:
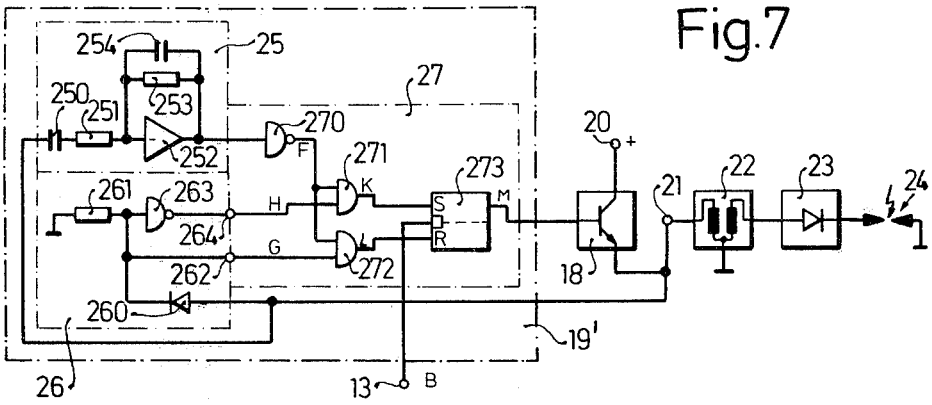
FIG. 7 is a fragmentary detailed diagram of another embodiment of the system in accordance with the present invention.

Embodiment of FIG. 7: Generally, the system of FIG. 7 corresponds to that of FIGS. 1 and 2. The electronic control system 19', however, is differently constructed and here includes a differentiator 25 and a polarity recognition stage 26. The inputs of differentiator 25 and of stage 26 are connected together and to terminal 21 (FIG. 1); the outputs are connected over a logic circuit 27 to the control input of the interrupter switch 18. Differentiator 25 uses a well-known differentiating circuit formed by the series circuit of a capacitor 250, a resistor 251, an inverting operational amplifier 252 and a feedback path consisting of a parallel connected resistor-capacitor network 253, 254.

The polarity recognition stage 26 has an input diode 260 and a resistor 261, serially connected to ground or chassis. The junction between diode 260 and resistor 261 is connected to an output 262 and, through an inverter 263, to a second output 264.

The output of differentiator 25 is connected through an inverter 270 to one input each of two AND-gates 271, 272; the second inputs of the AND-gates 271, 272 are, respectively, connected to the outputs 264, 262 of the polarity recognition stage. The output of the first AND-gate 271 is connected to the SET input of an RS flip-flop (FF) 273; the output of the second AND-gate 272 is connected to the RESET input of the FF 273. The output of FF 273 is connected to the control input of the interrupter switch 18. The clock or enabling input of FF 273 is connected to terminal 13 (FIG. 1), and has the signal B (FIG. 3) applied thereto.

Figure 8:
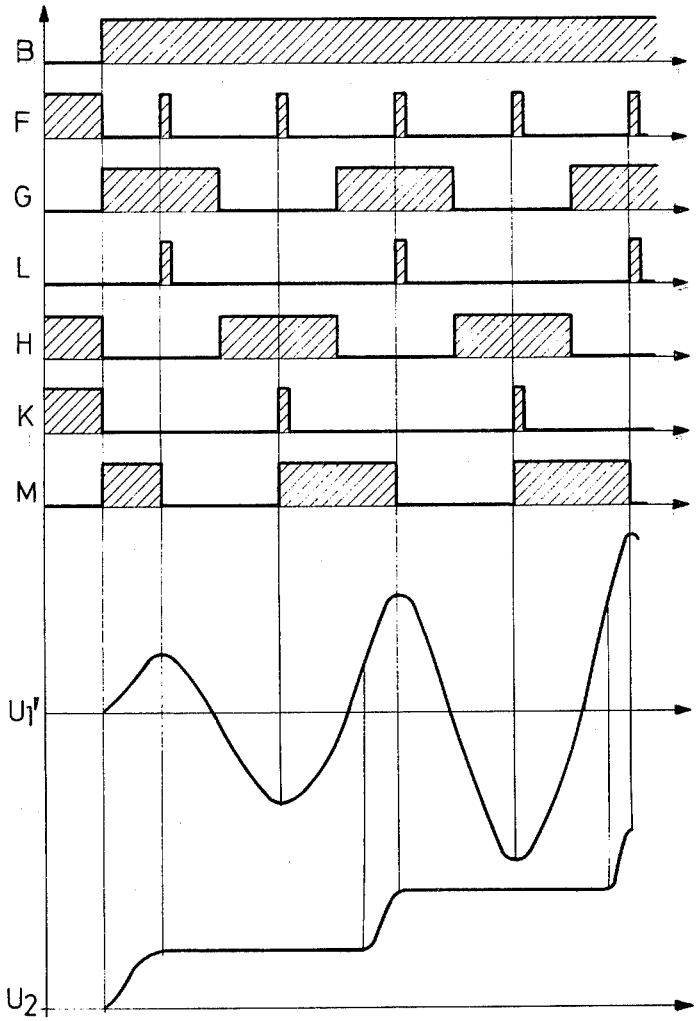
FIG. 8 is a series of graphs used in connection with explanation of the operation of the system of FIG. 7.

In the previously explained examples, the switching instants of the interrupter switch 18 were fixed, so that the switch-over of the voltage curve U1 was fixed by a predetermined frequency having a fixed ratio of signal duration to signal pause, that is, a fixed duty cycle. Frequency generator 16, therefore, operated in accordance with a predetermined fixed mode. The system of FIG. 7, however, provides recognition stages which recognize the occurence of a switch-over instant and then initiate the switch-over of the switch 18. The criterion to recognize the switch-over is the slope of the curve U1' (FIG. 8) which slope will become zero at the switch-over point; and, additionally, the polarity of the voltages at the switch-over points. The voltage U1' (FIG. 8) is the primary voltage of the ignition coil 22 which, essentially, is similar to that of the secondary voltage U1.

OPERATION, WITH REFERENCE TO FIG. 8

Differentiator 25 provides a signal at its output only if a voltage change is present at the input thereof. If the input at the voltage remains constant, the output voltage drops to zero. Since the rate of change, that is, the slope of the curve of the voltage U1', becomes zero when it approaches the switch-over point, that is, when the first re-charging cycle of the capacities formed by capacitor C1, C2 is terminated, the output voltage of the differentiator 25 will go to zero. At a predetermined threshold, therefore, a signal F will be generated at the output of the inverter stage 270.

If the change-over point is in the positive region, diode 260 is conductive and resistor 261 will have a positive voltage applied thereto which appears as the output signal G at terminal 262. Simultaneously, no signal is present at terminal 264 due to the presence of the inverter stage 263. If the voltage at terminal 21 is negative, so that diode 260 blocks, the output terminal 262 will have a zero signal and output terminal 264 will have the signal H. If, simultaneously, there is a signal F and H, the SET input of FF 273 will have the signal K. If, simultaneously, there is a signal F and a signal G, the RESET input of the FF 273 will have the signal L. During a clock signal B at terminal 13, FF 273 is enabled and then can be set by a signal K and reset by a signal L. As a consequence, the output signal at FF 273 will be the sequence of pulses shown at M in FIG. 8. The operation of the signal sequence M with respect to ignition voltage U2 is similar to that of the sequence E, as explained in connection with FIG. 4. The voltages U1' and U2 are shown also in FIG. 8.

The control voltage for the control unit 19 can be either the primary voltage U1' of the coil or the secondary voltage U1. The example in accordance with FIG. 7 does not need to particularly consider the different secondary capacities since the switch-over points of the voltages U1 or U1' are recognized in each instant by the electronic control system directly. The signal sequence B (FIG. 2) has superimposed thereon a signal sequence C so that a plurality of ignition sparks are generated for any ignition event; this is also advantageous for the example of FIGS. 7, 8. The signal lengths C or B, respectively, vary and can lead to a plurality of ignition events since the voltage accumulation or build-up of the voltage U2 will begin again after each ignition firing from zero level if a signal B or C continues to be applied.

Various changes and modifications may be made, and features explained in connection with any one of the embodiments may be used with any of the others.

EQUATIONS $$1=\pi\sqrt{L_s(C_1+C_2)} \quad (1)$$

$$p=\pi\sqrt{L_h \cdot C_1} \quad (2)$$

$$W2/W1=U2\ \max/(U_t-U_b) \quad (3)$$

$$p=\pi/2\sqrt{Lh(C_1+C_2)} \quad (4)$$

We claim:

1. In an internal combustion engine ignition system having an ignition coil (22);

a spark gap (24);

connecting means (23') serially connected with the secondary winding of the ignition coil (22) and the spark gap (24) and providing an energy storage means connected to the spark gap;

and a controlled interrupter switch (18) serially connected with the primary winding of the spark coil (22), a method to generate a high-voltage ignition spark and to cause an ignition event, comprising the steps of sequentially, in repetitive pulse cycles, applying a charge to the spark energy storage means connected to the spark gap (24);

preventing back-flow of energy away from the energy storage means connected to the spark gap (24);

and building up an energy accumulation in said energy storage means in form of a charge voltage accumulation as the result of said sequentially applied charges to the energy storage means until the energy stored therein causes breakdown of the spark gap, wherein the step of sequentially applying charges to the spark energy storage means comprises providing a plurality of pulses (E) having pulse periods (1) and pulse gaps (p) therebetween;

and timing the respective pulse periods and pulse gaps to obtain a built-up charge accumulation in the energy storage means connected across the spark gap sufficient to effect breakdown thereof.

2. Method according to claim 1, wherein the step of building up the voltage charge accumulation across the energy storage means comprises rapidly commanding opening and closing operation of the interrupter switch (18).

3. Method according to claim 1, wherein the timing step of comprises rapidly applying a pulse of energy to the energy storage means and controlling (a) the time duration of said pulses and (b) the time duration of the gaps between the pulses.

4. Method according to claim 3, wherein the time duration of the pulses and the time duration of the pulse gaps is controlled with respect to the voltage charge accumulation capacity of the energy storage means connected to the spark gap (24) to obtain the maximum charge necessary for breakdown of the spark gap under predetermined conditions with a plurality of pulses.

5. Method according to claim 1, wherein the ignition coil has inductance and capacity, and is operated as a current/voltage transformer having a large primary to secondary turns ratio and a large self-inductance with respect to leakage inductance (W1/W2 large; Lh>>Ls);

and wherein the duration (1) of the multiple pulses (E) corresponds essentially to the time duration necessary to reach said required charge accumulation to effect breakdown of the spark gap (24), the gaps (p) between the sequential pulses (E) corresponding approximately to the time required for oscillation of the coil and until the voltage (U1) at the capacity (C1) of the secondary of the coil has dropped from a maximum to a minimum.

6. Method according to claim 5, wherein the duration (1) of the pulses is defined by $$1=\pi\sqrt{L_s(C_1+C_2)}$$

and the gaps (p) between the pulses (E) is defined by $$p=\pi\sqrt{L_h \cdot C_1},$$

wherein $L_s$ is the leakage inductance of the ignition coil; $C_1$ is the capacitance of the ignition coil; $C_2$ is the capacitance of the energy storage means; $L_h$ is the main inductance of the ignition coil.

7. Method according to claim 1, wherein the ignition coil is operated as a blocking coil and has a low ratio of secondary to primary turns, a low self-inductance and a very small leakage inductance (W2/W1 small, Lh small, Ls very small);

the pulse duration (1) of the multiple pulses (E) is timed to fall within the linear range of the rise in primary current (Ib) through the coil (22), the gaps (p) between sequential pulses (E) being timed to correspond essentially to the period of time that maximum voltage, corresponding to said rate of change of current, is accumulated across said spark gap (24).

8. Method according to claim 7, wherein the gaps (p) between sequential pulses (E) are essentially defined by $$p=\pi/2\sqrt{Lh\,(C_1+C_2)},$$

wherein $L_h$ is the main inductance of the ignition coil; $C_1$ is the capacitance of the ignition coil; $C_2$ is the capacitance of the energy storage means.

9. High-voltage ignition system to generate ignition sparks and cause ignition events having an ignition coil (22);

a spark gap (24);

connecting means (23') serially connecting the secondary winding of the ignition coil (22) and the spark gap (24) and forming an electric charge storage element;

a controlled interrupter switch (18) serially connected with the primary winding of the ignition coil (22), and comprising signal generator means (15, 16, 19; 19') having a signal generation output, of a repetition rate which is high with respect to the duration of a spark impulse during an ignition event, the signal generator means being connected to control opening and closing of the interrupter switch (18) when a spark is to be generated to cyclically, sequentially apply charge pulses separated by pulse gaps from the ignition coil (22) to the charge storage element, and hence to the spark gap (24);

a uni-directional current flow element (23) included between said secondary winding of the ignition coil and said charge storage element (23') to prevent backflow of energy from the charge storage elements to the ignition coil;

the timing of the pulses and of the pulse gaps, and the storage capacity of the charge storage element being relatively dimensioned to obtain a built-up charge accumulation in the charge storage element sufficient to effect breakdown of the spark gap upon application thereto of said charge pulses separated by said pulse gaps;

and means (10) controlling generation and timing of the generation of signals controlling said ignition event.

10. System according to claim 9, wherein (FIGS. 7, 8) the signal generator means (19') comprises a signal generator providing pulses of variable duration (1) and with variable pulse gaps (p) between the pulses for each ignition event, said signal generator means being connected to said coil (22) and comprising means (25, 26) sensing rate of change and direction of rate of change of current flow through said coil;

said signal generator means controlling opening and closing, respectively, of said controlled interrupter switch (18) to close said interrupter switch for a pulse duration during which current through said coil rises approximately linearly, and then opens said interrupter switch until the voltage across said coil has reached a minimum.

11. System according to claim 9, wherein the signal generator means comprises a frequency generator (16) having a fixed frequency and a fixed relationship between pulse lengths (1) and pulse gaps (p);

the frequency of the frequency generator (16) being high with respect to the repetition rate (A) causing ignition events.

12. System according to claim 11, further comprising a logic circuit (14) connected to the output of the frequency generator (16) and said means generating the signals controlling an ignition event, said logic circuit being connected to the interrupter switch (18), said signal generator means (15, 16, 19; 19' being enabled to apply said pulses to said logic circuit when a signal controlling an ignition event is applied thereto.

13. System according to claim 12, wherein the signal generation means comprising a second frequency generator (15) and enabled by said means (10,11) generating the signals controlling an ignition event to generate a plurality of control signals for each ignition event, said second frequency generator being connected to said logic circuit (14);

the frequency of the second frequency generator being intermediate the frequency of said first frequency generator (16) and said means generating the signals controlling the ignition events (10, 11).

14. System according to claim 11, wherein said frequency generator (16) has at least one of: variable frequency; variable pulse duration; variable pulse gaps between sequential pulses.

15. System according to claim 9, for combination with an internal combustion engine;

wherein the means controlling timing of the ignition events comprises a transducer (10) providing said ignition event signals which is coupled to the crankshaft of the internal combustion engine.

16. System according to claim 9, wherein (FIGS. 7, 8) the signal generator means (19') comprises a differentiator (25);

a polarity recognition stage (26) and a logic circuit (27), the differentiator and the polarity recognition stage being connected to the ignition coil (22) to sense rate of change and direction of change of current or voltage relationships with respect to said coil, and a logic circuit (27) being connected to the control input of the controlled interrupter switch (18) to control opening and closing thereof.

17. System according to claim 16, wherein the logic circuit (27) comprises a bistable flip-flop (FF) (273) connected to the differentiator (25) and the polarity recognition stage (26) to provide a signal (L) to the flip-flop (23) when the voltage (U1') at the coil (23) is essentially a maximum and a second signal (K) to another input of the flip-flop (273) when the voltage (U1') at the coil (23) is, effectively, a minimum.

18. System according to claim 17, further comprising logic gates (271, 272) connected between the differentiator (25) and the polarity recognition stage (26) to, respectively, connect said signals (L, K) to the respective inputs of the flip-flop (273).

19. System according to claim 16, wherein the polarity recognition stage (26) comprises the series circuit of a diode (260) and a resistor (261), said polarity recognition stage having a first output connected to the junction of said diode and resistor;

and an inverter (263) connected to the junction between the diode and the resistor and providing a second output representative of reverse polarity.

20. In an internal combustion engine ignition system having an ignition coil (22) operated as an electromagnetic energy storage device;

a spark gap (24);

connecting means (23') serially connected with the secondary winding of the ignition coil (22) and the spark gap (24) and providing an energy storage means connected to the spark gap;

and a controlled interrupter switch (18) serially connected with the primary winding of the spark coil (22), a method to generate a high-voltage ignition spark and to cause an ignition event, comprising the steps of sequentially, in repetitive pulse cycles applying a charge to the spark energy storage means connected to the spark gap (24);

preventing back-flow of energy away from the energy storage means connected to the spark gap (24);

building up an energy accumulation in said energy storage means in form of a charge voltage accumulation as the result of said sequentially applied charges to the energy storage means until the energy stored therein causes breakdown of the spark gap;

timing the pulse duration (1) of the sequential pulses (E) in the pulse cycles to fall within the linear range of current rise (Ib) through the primary of the coil (22) upon closing of said interrupter switch (18);

and controlling the pulse gaps (p) between the sequential signals (E) to be short with respect to the lengths (1) of the pulses (E).

21. Method according to claim 20, wherein the step of sequentially applying charges comprises applying said charges in the form of pulses recurring at a fixed pulse repetition rate.

22. In an internal combustion engine ignition system having an ignition coil (22);

a spark gap (24);

connecting means (23') serially connected with the secondary winding of the ignition coil (22) and the spark gap (24) and providing an energy storage means connected to the spark gap;

and a controlled interrupter switch (18) serially connected with the primary winding of the spark coil (22), a method to generate a high-voltage ignition spark and to cause an ignition event comprising the steps of sequentially, in repetitive pulse cycles, applying pulses to the primary of the ignition coil to thereby apply a charge to the spark energy storage means connected to the spark gap (24);

sensing the oscillation pattern resulting from application of a pulse in said cycle and detecting when the voltage across said ignition coil has dropped to a minimum upon an oscillatory swing, and the oscillatory swing is about to reverse;

applying a subsequent pulse to said coil upon such reversal;

and repeating application of pulses to said coil, timed in accordance with said sensed voltage and rate of change of voltage relationship as the coil oscillates;

discontinuing application of current to the coil when current flow therethrough is no longer linear;

timing the application of current to the coil in accordance with sensed current flow, within a linear range, and sensed reversal of voltage to provide pulses to the coil in which the pulse duration and pulse gaps are controlled by the oscillatory state of the coil and the circuit connected thereto;

and preventing back-flow of energy away from the energy storage means connected to the spark gap (24) to build up an energy accumulation in said energy storage means in form of a charge voltage accumulation as the result of said sequentially applied charges to the energy storage means until the energy stored therein causes breakdown of the spark gap.

* * * * *